US008052222B2

(12) United States Patent
Driesen et al.

(10) Patent No.: US 8,052,222 B2
(45) Date of Patent: Nov. 8, 2011

(54) BRISTLE CLUSTER STUFFING TOOL RAM AND METHOD OF USE

(75) Inventors: Georges Driesen, Weilrod (DE); Wolfgang Schuppert, Karbach (DE); Michael Dumig, Erlenbach (DE)

(73) Assignee: The Procter & Gamble Company, Cincinnati, OH (US)

( * ) Notice: Subject to any disclaimer, the term of this patent is extended or adjusted under 35 U.S.C. 154(b) by 1236 days.

(21) Appl. No.: 10/552,979

(22) PCT Filed: Mar. 20, 2004

(86) PCT No.: PCT/EP2004/002958

§ 371 (c)(1), (2), (4) Date: Apr. 18, 2006

(87) PCT Pub. No.: WO2004/089157

PCT Pub. Date: Oct. 21, 2004

(65) Prior Publication Data

US 2006/0208557 A1 Sep. 21, 2006

(30) Foreign Application Priority Data

Apr. 12, 2003 (DE) ..... 103 16 963

(51) Int. Cl.
*A46D 3/04* (2006.01)

(52) U.S. Cl. ..... 300/21

(58) Field of Classification Search ..... 300/8, 9, 300/4, 5, 2, 19, 21; 227/16; *A46B 3/16*
See application file for complete search history.

(56) References Cited

U.S. PATENT DOCUMENTS

| | | | | |
|---|---|---|---|---|
| 746,943 | A * | 12/1903 | Fisher et al. | 300/8 |
| 801,026 | A * | 10/1905 | Liebig | 300/8 |
| 2,084,345 | A * | 6/1937 | Jobst | 300/8 |

FOREIGN PATENT DOCUMENTS

| | | |
|---|---|---|
| DE | 0 315 729 | 4/1988 |
| DE | 195 07 186 | 3/1995 |
| DE | 195 28 762 | 8/1995 |
| EP | 1 088 495 | 4/2001 |
| FR | 894 348 | 12/1944 |

* cited by examiner

*Primary Examiner* — Lee D Wilson
*Assistant Examiner* — Jamal Daniel

(57) ABSTRACT

A bristle cluster stuffing tool ram is used for pressing a strip-shaped holding element, preferably an anchor, into a borehole that is arranged in a brush head and serves for accommodating a bristle cluster. The end face of the ram comprises a pressing surface for pressing in the holding element. The pressing surface is defined by longitudinal sides and face sides. The rain has end face regions that penetrate into the material of the brush head when the holding element is pressed in. The cross section of the ram that lies outside the end face regions and penetrates into the borehole is wider than the end face regions.

7 Claims, 1 Drawing Sheet

BRISTLE CLUSTER STUFFING TOOL RAM AND METHOD OF USE

TECHNICAL FIELD

The invention pertains to a stuffing tool ram that is used for pressing a strip-shaped holding element into a borehole in a toothbrush head that accommodates a bristle cluster.

BACKGROUND

DE 195 28 762 C1 discloses a ram that has a rectangular cross section, the thickness of which essentially corresponds to the individual force-fitting surfaces of the vertically packed staples that are generally referred to as holding elements or anchors. The ram severs the anchors from a metal strip that extends perpendicular to the longitudinal axis A of the ram. The longitudinal axis of the ram extends parallel to the center lines of the bores in the toothbrush head, i.e., when a borehole is stuffed with a bristle cluster, its center axis is aligned with the longitudinal axis of the ram. The pressing surface of the ram is referred to as the end face. The ram has wider longitudinal sides and narrower face sides that form a rectangle and the cross section of which essentially corresponds to the cross section of the holding elements.

A bristle cluster extends perpendicular to the longitudinal axis of the ram, wherein this bristle cluster is subsequently pressed into a borehole and deformed into the shape of a U while being pressed into the borehole. The lateral edges of the holding element actually cut into the edge of the borehole in the brush head during this process. The ram presses the holding element into the edge material of a borehole in the brush head until the anchor no longer protrudes from the surface of the brush head. The slot produced in the borehole wall by the anchor while it is pressed into the borehole presses against the edges of the longitudinal sides of the anchor with such intensity that the anchor is rigidly fixed in the brush head and the bristle cluster is immovably anchored in the borehole.

EP 1 088 495 A also discloses a stuffing tool ram that is used for driving a strip-shaped holding element into a borehole that accommodates a bristle cluster. A thin metal wire extending perpendicular to the ram is inserted into the stuffing tool. The free end of the wire perpendicularly protrudes into the channel guiding the ram. When the ram is displaced in the direction of the toothbrush, it shears off a section of wire that is then transported in the direction of the toothbrush head along the channel and ultimately forms the holding element. During the displacement of the ram, the holding element collects a bristle cluster consisting of numerous filaments, wherein the holding element centrally deforms the bristle cluster into the shape of a U. The bristle cluster is then pressed into a borehole in the toothbrush together with the anchor in this fashion. The holding element is pressed into the borehole until it is no longer accessible from outside and the free end of the bristle cluster protrudes from the borehole by a predetermined distance. The end face regions of the holding element carve into the wall of the borehole such that grooves are formed. Due to the elastic material of the brush head, these grooves firmly press against the lateral faces of the holding element and thusly hold the holding element in the borehole. The bristle cluster can be reliably anchored in the borehole in this fashion.

In modern toothbrushes, the bores frequently are no longer aligned with the longitudinal axis of the ram, i.e., the bores are inclined relative to this longitudinal axis such that the bristle clusters do not perpendicularly protrude from the surface of the toothbrush head, but rather with a certain incline. Practical experience showed, however, that this frequently leads to damages to the pressing surfaces or to the end of the ram breaking off. This is associated with significant installation and repair expenditures because the ram needs to be removed from the stuffing tool, trimmed and contoured anew. In addition, this also leads to significant production losses because no toothbrush heads can be stuffed during these repair procedures.

Consequently, it is desirable to provide a ram with a service life that is not only extended when it is used in connection with bores that are aligned with the longitudinal axis of the ram, but also bores that are inclined relative to the longitudinal axis of the ram, wherein this ram is also not subject to a premature fractures or other damages. It is also desirable that the holding elements or anchors can be neatly and precisely pressed into the boreholes in order to reliably hold the bristle clusters in the boreholes.

SUMMARY

In one aspect of the invention, the pressing surface of a bristle cluster stuffing tool ram is enlarged and the moment of resistance and the moment of bending of the ram are increased in that the cross section of the ram is outwardly widened in the central region of its lateral faces. The enlarged pressing surface ensures that the holding element or anchor is also taken hold of by the enlarged ram surface if it attempts to slightly slide away laterally while it is pressed into the borehole. This means that the anchor can be neatly pressed into the brush head. Due to its increased moment of resistance, the ram is able to withstand higher loads while the holding element is pressed into the brush head, namely even in the presence of possible lateral loads. This means that the ram does not fracture prematurely. The enlarged pressing surface of the ram has the advantageous effect of largely preventing the "sliding effect" and therefore the risk of fracturing the ram, namely even in instances in which the end face of the holding element is typically rounded. The same effect is also achieved when pressing partition walls into boreholes because these partition walls are pressed into the boreholes in accordance with the same principle. Partition walls are used for dividing an oblong or oval borehole into several borehole sections and stuffing each partial borehole.

The thickening and stabilizing of the ram in the region of the borehole allows a superior guidance of the anchoring wires—independently of the borehole incline or the rounding of the anchoring wire. The number of ram fractures can be significantly reduced. In addition, the width of the gap or cut in the edge of the borehole (penetrating region of the anchor) also is defined by the width of the anchor only and not by the shape of the ram. In this case, the ram cross section is only noticeably widened in the region that penetrates into the borehole—but not into the borehole wall. The bristle extraction forces are not changed in comparison with conventional stuffing methods because the brush head is subjected to an analogous mechanical deformation by the holding element or anchor, respectively.

If one would forgo the widening of the ram cross section and instead widen the anchors, the edges of the borehole would be damaged more significantly when the anchors are pressed in due to the higher compressive forces. When using thicker anchoring wires, it would also be conceivable to stuff a significantly smaller number of bristles into a brush head with identical borehole geometry. However, this would result in increased wear of the bristles when the toothbrush is used. For example, if the borehole has a diameter of 1.5 mm, the number of bristles would be reduced by 5.1% if anchors with a width of 0.25 mm are used rather than anchors with a width of 0.2 mm.

The thickening of the lateral faces cannot exceed the diameter of a borehole because the thickening of the ram would otherwise carve into and damage the edge of the borehole when a holding element is pressed in. The thickening on the pressing surface of the ram consequently is limited to the area of the borehole. The cross section of the pressing surface of the ram can also be increased by providing a thickening on one lateral face of the ram only.

The ram can be manufactured in a particularly simple fashion if its cross-sectional widening is realized in the form of a step. This makes it possible to achieve the greatest increase in cross section possible behind the region that no longer penetrates into the material of the brush head. The cross section may be widened in a rectangular fashion, a trapezoidal fashion or in the shape of a pitch circle. In this respect, it is advantageous that the corner radii are as large as possible in order to maintain the notch stress on the ram as low as possible. The corners can be subsequently machined into the sintered hard metal sheet by means of milling, grinding or the like. It would also be conceivable, however, to realize the ram in the form a rolled profile sheet that was hardened and tempered in order to achieve the required strength.

In some embodiments, the pressing end of the ram is realized in the shape of a wedge. This prevents the plastic area from being cut more significantly than usual, namely because the bristle extraction forces would otherwise be reduced and the height of the protruding bristles would be increased. When using a pressing surface with a size of 1.1 mm in order to the press an anchor into a borehole with a diameter of 1.5 mm to a minimum depth of 0.85 mm, this means that the point needs to be angled by no less than 75°. If the borehole has a diameter of 1.7 mm, the size of the pressing surface is increased by 0.2 mm, wherein the minimum angle is maintained at 75° in this case.

In some embodiments, the size of the pressing surface exceeds the size of the holding element surface acted upon by the ram by approximately 10-40%, preferably 25% These dimensions make it possible to realize a particularly stable ram that has a significantly longer service life than conventional rams.

In some embodiments, the brush head preferably consists of an injection-molded plastic part. The ram is particularly advantageous for manufacturing toothbrushes in which a particularly large number of boreholes needs to be stuffed with bristle clusters, namely because a significantly longer service life of the ram can be achieved in this case. However, the pressed-in bristles may also form part of a brush, a broom, a paintbrush or a similar tool comprising bristles.

One embodiment of the invention is illustrated in the figures and described in greater detail below. The figures show:

DETAILED DESCRIPTION

A device for pressing a holding element into a borehole in a brush head by means of a ram is described in detail in DE 195 28 762 C1 and EP 1 088 495 A1, the entire contents of which are incorporated into the present application by reference.

Figure 1:
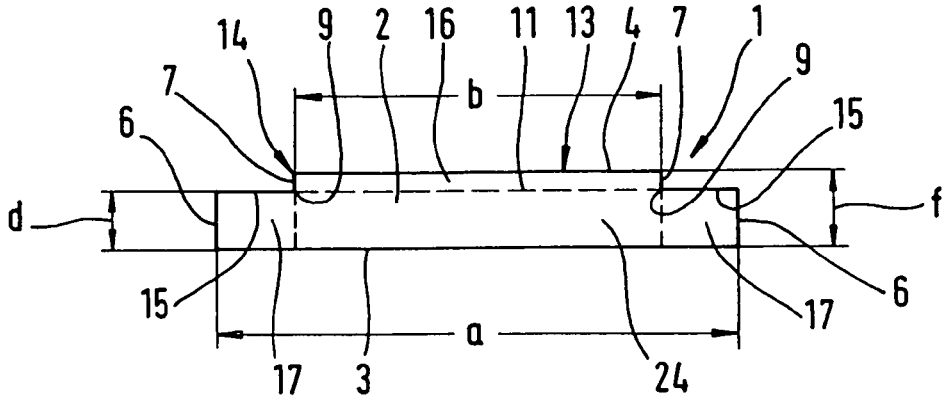
FIG. 1 is an enlarged top view of the pressing surface of a ram.
Figure 2:
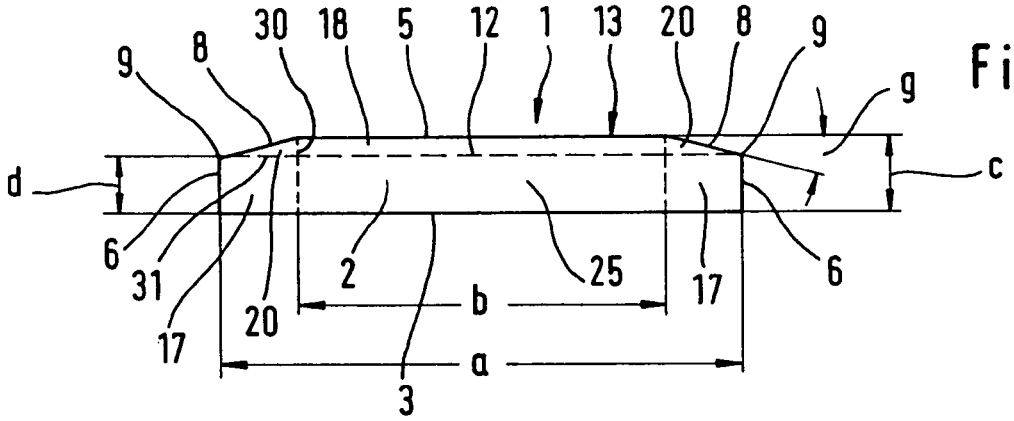
FIG. 2 is an enlarged top view of a ram pressing surface that is slightly modified in comparison with FIG. 1.
Figure 4:
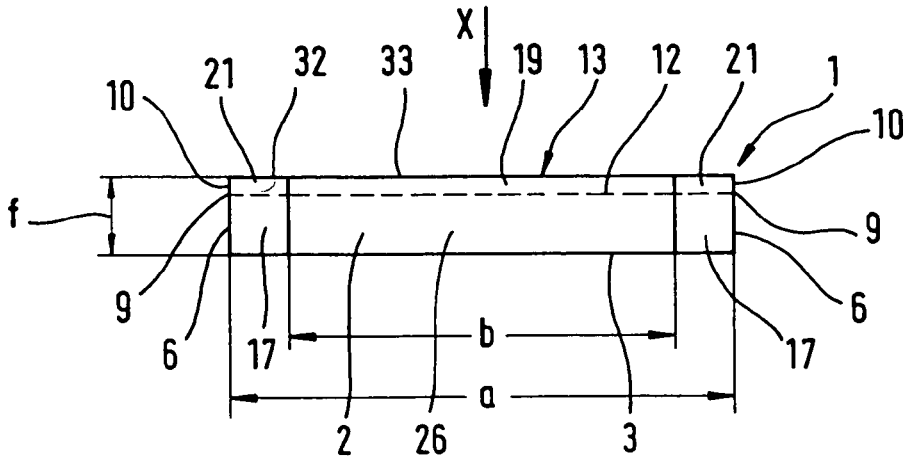
FIG. 4 is an enlarged top view of an additionally modified ram pressing surface.

In FIGS. 1, 2 and 4, the pressing surface 2 extends in the plane of projection. The ram 1 can also be utilized in existing stuffing machines by adapting the lateral profiles of the slots in the stuffing tool to the newly designed ram 1.

In FIGS. 1, 2 and 4, the pressing surface 2 is defined by one longitudinal side 3 and face sides 6 of identical length extending perpendicular thereto, and a fourth side. The pressing surface consists of a projecting area 16 (defined by the narrower face side 7 and the narrower longitudinal side 4) in FIG. 1, of the projecting area 18 and the two triangular projecting areas 20 on both corner regions 17 in FIG. 2, and of the projecting area 19, the size of which corresponds to that of the projecting areas 16 and 18, respectively, as well as the two rectangular projecting areas 21 on both corner regions 17 in FIG. 4. The triangular projecting area 20 according to FIG. 2 is formed by the face side 8 that extends transversely upward and the face sides 30, 31 that lie perpendicular to one another. The rectangular projecting area 21 according to FIG. 4 is formed by the perpendicularly extending face sides 10 and the horizontally extending lateral faces 32. The longitudinal sides 3 extend parallel to the longitudinal sides 4, 15; 5; 33. The narrower face sides 7 extend perpendicular to the longitudinal sides 3, 4 in FIG. 1.

In FIG. 1, the longitudinal side 3 has the length a and the narrower longitudinal side 4 has the length b. In FIG. 2, the longitudinal side 3 has the length a and the narrower longitudinal side 5 has the length b. According to FIGS. 1 and 2, the face sides 6 and the longitudinal side 3 form a rectangular surface, wherein the imaginary longitudinal sides 11, 12 that lie opposite of lower longitudinal side 3 are drawn with broken lines in the figures. On the upper side 13 shown in FIG. 1, a step 14 is arranged on both sides at a distance (a−b)/2, wherein said steps extend perpendicular to the longitudinal side 3 and consequently parallel to the face sides 6. The short longitudinal sides 15 with the lengths (a−b)/2 extend parallel to the longitudinal side 3 in FIG. 1. The projecting area 17 defined in part by the longitudinal sides 15 and the face sides 6 is the area that penetrates into the wall of the borehole when a holding element (not-shown) is pressed in such that the remaining area covered by the width b would penetrate into a borehole and therefore be in contact with the wall of the borehole.

According to FIG. 1, the area defined by the face side 7 and the shorter longitudinal side 15 represents the projecting area 16 of the ram 1. This projecting area 16 is increases the size of the pressing surface relative pressing surfaces known from the state of the art that usually have the dimensions a·d only. In FIG. 2, the pressing surface 2 including the total projecting area 18, 20 is larger than the pressing surface 2 including the projecting area 16 according to FIG. 1 by the triangular surface 20. In this case, the narrow face side 8 preferably extends at an angle g of approximately 8°±2°.

The area that extends beyond the length b and forms the end face region 17 of the ram 1 in FIGS. 1, 2 and 4 is the area that penetrates into the borehole wall of a brush head and presses the holding element into the borehole to such a degree that it no longer protrudes from the brush head surface on the bristle side after the ram is retracted from the borehole. In FIG. 1, the cross-sectional area 24, 25, 26 between the end face regions 17 of the ram 1 penetrating into the borehole is wider than the end face regions 17 on the face sides by the projecting area 16.

A comparison between the narrow face side 8 according to FIG. 2 and the narrow face side 15 according to FIG. 1 makes it clear that the penetration of the ram 1 shown in FIG. 2 causes more brush head material to be displaced than the penetration of the ram 1 shown in FIG. 1. The most material is displaced by the ram 1 shown in FIG. 4, because the narrower face side 10 in the form of a rectangle is superimposed on the face side 6 and this end face region 21 is situated directly adjacent to the face side 6. The projecting areas 19 according to FIG. 4 with the corresponding end face regions 21 define the largest cross-sectional area, i.e., this ram 1 has the highest flexural rigidity. The ram according to FIG. 2 has a slightly lower flexural rigidity than the ram 1 shown in FIG. 4, and the ram 1 shown in FIG. 1 has the lowest flexural rigidity relative to the rams 1 shown in FIGS. 2 and 4, because it does not contain any projecting areas in its end face regions 17. In contrast to the ram 1 shown in FIG. 2, the ram 1 shown in FIG. 1 does not displace any material on the borehole wall when it is pressed into a borehole, wherein the material displacement in comparison with the former ram is doubled when the ram 1 shown in FIG. 4 is pressed into a borehole. The reason for this can be seen in that the projecting areas 21 of the end face regions 17 are nearly twice as large as the projecting areas 20 of the end face regions 17 in FIG. 2.

In an exemplary embodiment, the width d is about 0.2 mm for a borehole that has a diameter of approximately 1.5 mm. The ram has a length a of about 2 mm and a length b of about 1 mm. The overall lengths c and f on the respective face sides 6, 7 and 8 are about 0.25 mm, and the length d on the face side 6 is about 0.2 mm. For an exemplary embodiment as shown in FIG. 4, the length a of the lateral face 3 is also about 2 mm and the length f is about 0.25 mm. For embodiments used in association with boreholes having a larger diameter, the corresponding parameters are also proportionally increased.

Figure 3:
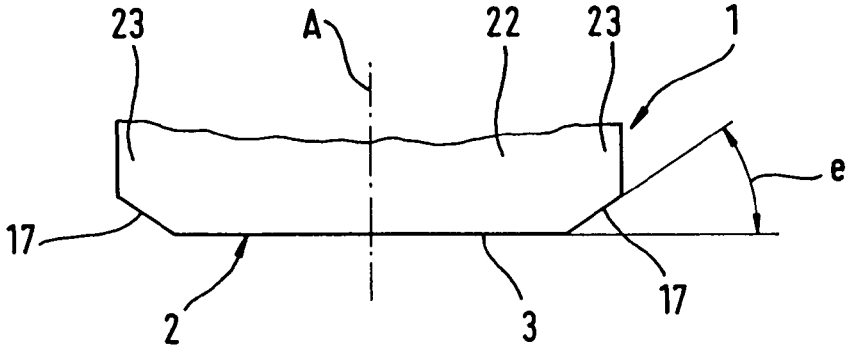
FIG. 3 is an enlarged side view of the ram of FIG. 4.

In FIG. 3, the longitudinal surfaces 22 situated adjacent to the longitudinal sides 3 on both opposite sides as well as the face sides 23 situated adjacent to the top of the end face regions 17 on both opposite sides form the outer surfaces of the ram 1. The face sides 23 are beveled outward at the end face regions 17 by an angle e of 75°. This simplifies the penetration of the ram 1 into a borehole in the brush head because the surface of the end face regions 17 gradually increases as the ram penetrates into the material. The end face regions 17 according to FIG. 3 consequently form a wedge-like surface such that the penetrating resistance only increases gradually and damages to the ram and to the toothbrush head are prevented.

What is claimed is:

1. A method of manufacturing a brush, the method comprising providing a brush head defining bristle cluster boreholes;

providing a stuffing tool ram with opposed broad longitudinal sides and a pressing surface that includes a central region and two end regions, the central region having a width as measured between the broad longitudinal sides greater than a width of the end regions, a first broad longitudinal side of the ram disposed between ends of face sides of the ram and a second broad longitudinal side of the ram opposite the first broad longitudinal side, wherein the second broad longitudinal side is shorter than the first broad longitudinal side; and with the ram, pressing strip-shaped holding elements into engagement with corresponding bristle clusters and into corresponding boreholes with the end regions of the ram pressing surface penetrating into the material of the brush head as the central region extends into the borehole, thereby anchoring the bristle cluster in the borehole.

2. The method according to claim 1 comprising a method of manufacturing a toothbrush, wherein the brush head is a toothbrush's head.

3. The method according to claim 1 wherein pressing the holding element comprises pressing the holding elements into corresponding boreholes inclined relative to a longitudinal axis of the ram.

4. The method according to claim 1, wherein the width of the central region is between 10 percent and 80 percent greater than the width of the end regions.

5. The method according to claim 4, wherein the width of the central region is between 25 percent and 50 percent greater than the width of the end regions.

6. A method of manufacturing a toothbrush, the method comprising providing a brush head defining bristle cluster boreholes;

providing a stuffing tool ram with opposed broad longitudinal sides and a pressing surface that includes a central region and two end regions, the central region having a width as measured between the broad longitudinal sides greater than a width of the end regions, a first broad longitudinal side of the ram disposed along a first line extending between ends of face sides of the ram and a second broad longitudinal side of the ram extending outward relative a second line extending between ends of the face sides of the ram such that the central regions includes an enlarged projecting area is disposed on one of the broad longitudinal sides of the ram; and with the ram, pressing strip-shaped holding elements into engagement with corresponding bristle clusters and into corresponding boreholes with the end regions of the ram pressing surface penetrating into the material of the brush head as the central region extends into the borehole, thereby anchoring the bristle cluster in the borehole, wherein the boreholes are inclined relative to a longitudinal axis of the ram.

7. A method of manufacturing a brush, the method comprising providing a brush head defining bristle cluster boreholes;

providing a stuffing tool ram with opposed broad longitudinal sides and a pressing surface that includes a central region and two end regions, the central region having a width as measured between the broad longitudinal sides greater than a width of the end regions, a first broad longitudinal side of the ram disposed along a first line extending between ends of face sides of the ram and a second broad longitudinal side of the ram extending outward relative to a second line such that the central region includes an enlarged projecting area disposed on only one of the broad longitudinal sides of the ram; and with the ram, pressing strip-shaped holding elements into engagement with corresponding bristle clusters and into corresponding boreholes with the end regions of the ram pressing surface penetrating into the material of the brush head as the central region extends into the borehole, thereby anchoring the bristle cluster in the borehole, wherein the boreholes are inclined relative to a longitudinal axis of the ram.

* * * * *